United States Patent [19]

Satoh et al.

[11] 4,369,448

[45] Jan. 18, 1983

[54] MICROWAVE ANTENNA WITH RADIATION SCATTERING SUPPORT MEMBER ELEMENTS

[75] Inventors: Hideo Satoh; Naoto Matsunaka, both of Tokyo, Japan

[73] Assignees: Kokusai Denshin Denwa Co., Ltd.; Mitsubishi Denki Kabushiki Kaisha, both of Tokyo, Japan

[21] Appl. No.: 269,216

[22] Filed: Jun. 2, 1981

[30] Foreign Application Priority Data

| | | | |
|---|---|---|---|
| Jun. 3, 1980 | [JP] | Japan | 55-74544 |
| Jun. 3, 1980 | [JP] | Japan | 55-17545 |
| Jun. 3, 1980 | [JP] | Japan | 55-74546 |
| Jun. 3, 1980 | [JP] | Japan | 55-74547 |
| Jun. 3, 1980 | [JP] | Japan | 55-74548 |
| Jun. 3, 1980 | [JP] | Japan | 55-74549 |
| Jun. 3, 1980 | [JP] | Japan | 55-74550 |

[51] Int. Cl.[3] ..... H01Q 19/14

[52] U.S. Cl. ..... 343/781 CA; 343/18 B

[58] Field of Search ..... 343/18 B, 781 R, 781 CA, 343/781 P, 872

[56] References Cited

U.S. PATENT DOCUMENTS

| | | | |
|---|---|---|---|
| 3,296,685 | 1/1967 | Suliteanu | 343/872 |
| 3,396,396 | 8/1968 | Charlton et al. | 343/872 |
| 3,530,469 | 9/1970 | Dailey et al. | 343/18 B |
| 4,148,039 | 4/1979 | Lunden | 343/872 |
| 4,189,731 | 2/1980 | Rope et al. | 343/872 |

*Primary Examiner*—David K. Moore

*Attorney, Agent, or Firm*—Sughrue, Mion, Zin, Macpeak & Seas

[57] ABSTRACT

An antenna, such as Cassegrain or parabolic antenna, intended for use in the microwave or millimeter wavebands having improved wide angle radiation characteristics. At least one edge portion, in first embodiments, of a supporting post structure which supports a primary radiator or subreflector is modified to randomly scatter waves so that the field strength of scattered waves due to the presence of the supporting post is decreased.

17 Claims, 38 Drawing Figures

MICROWAVE ANTENNA WITH RADIATION SCATTERING SUPPORT MEMBER ELEMENTS

BACKGROUND OF THE INVENTION

The present invention relates to a reflector antenna intended for use in the microwave band or the millimeter wave band. More particularly, the invention relates to an antenna device having excellent wide angle radiation characteristics.

FIG. 1 shows the arrangement of a Cassegrain antenna, which is an example of a conventional reflector antenna.

In FIG. 1, reference numeral 1 designates a main reflector, 2 a subreflector, 3 a primary radiator, and 4 a supporting strut for supporting the subreflector. A spherical wave radiated by the primary radiator 3 of the reflector antenna thus constructed is converted into a plane wave upon being reflected by the subreflector mirror 2 and the main reflector 1. The plane wave is radiated outwardly. In this operation, the plane wave 5 reflected by the main reflector 1 is scattered by the supporting strut 4. In this case, the scattered wave 6 is composed of the reflected wave from the surface and the diffracted wave from the edge.

The section, on the main reflector side, of the conventional supporting strut 4 may be circular as shown in FIG. 2B or rectangular as shown in FIG. 2C. Therefore, the scattered waves 6 formed by these supporting struts have the radiation patterns as follows. If it is assumed that, as shown in FIG. 2A, the supporting strut 4 forms an angle $\theta$ with the Z-axis when the plane wave 5 advances in the positive direction of the Z-axis, and if, as shown in FIG. 3A, the observation point P has the coordinates (H, $\Phi$) in polar coordinates with the Z-axis as the polar axis, then the direction of advancement of the reflected wave due to the supporting strut 4 can be represented by the following expression (1):

$$\tan \Phi = \frac{1}{\cos \Phi \tan \psi}, \sin \frac{H}{2} = \sin \theta \sin \psi \qquad (1)$$

where $\psi$ is the angle formed between the plane Z-X and a normal line extending from the point on a reflection surface 8 at which the plane wave 5 is applied.

The direction of the diffracted wave is in the form of a cone having an edge 7 as the central axis and having a half vertical angle $\theta$. In the case of FIG. 2B, the supporting strut 4 has a curved surface which has a continuously changing value $\psi$. Therefore, the reflected wave is radiated in the form of a circular cone which has the supporting strut 4 as its central axis and has a half vertical angle $\theta$. On the other hand, in the case of the supporting strut 4 shown in FIG. 2C, a reflected wave is produced due to a reflection surface 8 where the value $\psi$ is 90 degrees and waves are refracted due to edges 7. The reflected wave is radiated in the negative direction along the Z axis (−Z), while the diffracted waves are radiated conically.

The radiation patterns of the scattered waves due to the conventional supporting struts shown in FIGS. 2B and 2C are as shown in FIGS. 3B and 3C, respectively. In FIGS. 3B and 3C, the higher the density of lines shown therein, the higher the field intensity level. As is apparent from these figures, the field intensity level is high in the direction of scattering, and it is not low even in the region where the value H is large. This degrades the wide angle radiation characteristics of the antenna.

Therefore, the use of such an antenna may cause interference with other radio systems.

This difficulty may be eliminated by employing a technique whereby a microwave absorber is provided on the surface of the supporting strut, or a technique whereby, as shown in FIG. 4, metal plates 9 are arranged at a certain pitch on the supporting strut 4, or a technique whereby metal elements which are shorter than the wavelength employed are irregularly arranged on the supporting strut. However, the first technique is disadvantageous in that it is impossible for the microwave absorber to completely absorb the scattered waves, and it is rather difficult to provide such a material which has satisfactory weather-proof characteristics. The second technique is also disadvantageous in that a grating lobe is formed according to the pitch at which the metal plates are arranged. The third technique has a drawback that, although the reflected wave can be scattered, it is difficult to scatter the diffracted wave.

SUMMARY OF THE INVENTION

The present invention is intended to eliminate the above-described difficulties. According to the invention, a triangular strut is connected to a part or the whole of a surface of the supporting strut, the length of the triangular strut in the longitudinal axis of the supporting strut being longer than the wavelength of a radio wave radiated thereby, and a structure in the form of a plate having a thickness less than the radial wavelength is connected to the edge of the triangular strut.

Moreover, in order to eliminate the above-described difficulties, according to the invention, a plurality of plural types of quadrangular prisms which are different in the length or height of the base thereof are irregularly arranged on a part or the whole of a surface of the supporting strut.

Yet further, in order to eliminate the above-described difficulties, according to the invention, a part or the whole of a surface of the supporting strut is modified into one having a special configuration.

Yet still further according to the present invention, a specially-shaped planar member whose thickness is smaller than the radiated wavelength is provided on a portion or the whole of a surface of the supporting strut structure. Preferably, the planar member has an edge formed in an irregular zigzag shape.

Still further in order to remove such defects, according to the present invention, specially-shaped planar members the thickness of which is less than the radiated wavelength are provided on a portion or whole of a surface of the supporting strut on two sides thereof. The planar members have zigzag shaped edges, which may be similar or different between planar members.

According to another embodiment of the present invention, a strut whose cross-sectional shape is triangular and whose length along the supporting strut is longer than the radiated wavelength is formed on a portion or the whole of the surface of the supporting strut.

Further according to the invention, there is provided a strut triangular in section whose longitudinal length along the longitudinal direction of a supporting strut is longer than the radiated wavelength mounted on a part or the whole of a surface of the supporting strut. Structures in the form of flat plates each having a thickness less than the radiated wavelength are connected to three longitudinal edges of the triangular strut.

BRIEF DESCRIPTION OF THE DRAWINGS

FIGS. 5A, 5B, 6–8, 10, 11A–16A and 17–19 are diagrams illustrating various supporting strut structures for an antenna of the present invention;

DESCRIPTION OF THE PREFERRED EMBODIMENTS

Figure 5B:
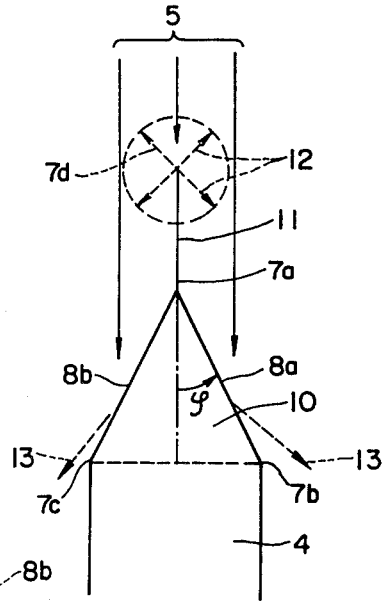
Figure 5A:
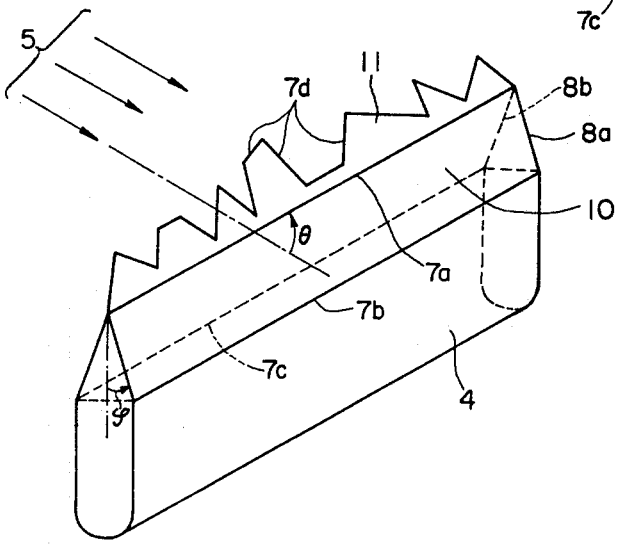

FIGS. 5A and 5B show a preferred embodiment of a strut structure of an antenna of the invention, of which FIG. 5A is a perspective view and FIG. 5B is a cross-sectional view. In FIGS. 5A and 5B, reference numeral 4 designates a supporting strut, 5 a plane wave passing the supporting strut, 10 a triangular strut, and 11 a plate structure. The cross-section of the strut 10, which is positioned parallel to the longitudinal axis of the supporting strut 4, is in the form of a triangle. The length of one side of the triangle adjacent the supporting strut 4 is equal to the width of the supporting strut 4, and the length of each of the remaining sides is longer than the wavelength of radiated waves. The length of the triangular strut 10 in the longitudinal direction of the supporting strut is longer than the wavelength. The plate structure 11 is a flat plate having a thickness less than the radiated wavelength. One edge of the structure 11 is connected to the lateral edge of the triangular strut 10 while the other edge is formed as a polygonal line having a number of sides each of which is longer than the wavelength. For a Cassegrain antenna, the triangular strut 10 is provided on the surface, faced to the main reflector side, of the supporting strut. For a parabolic antenna, the triangular strut 10 is provided on the surface of the supporting strut faced to the main reflector side. The structure 11 is coupled to the lateral edge of the triangular strut 10 in such a manner that it is parallel to a plane which includes both the longitudinal direction of the supporting strut and the direction of advancement of the plane wave 5.

In FIG. 5A, reference character *7a* designates the aforementioned lateral edge which is the connecting line between the structure 11 and the triangular strut *7b* and *7c* edges which are the connecting lines between the triangular strut 10 and the supporting strut 4, and *7c* an edge of the structure 11 which forms the aforementioned polygonal line. With the above-described arrangement, the scattered wave of a plane wave 5 due to the supporting strut 4 can be represented by the superposition of diffracted waves due to edges *7a*, *7b*, *7c* and *7d* and reflected waves due to the surfaces 8*a* and 8*b*. The reflected waves 13 due to the surfaces 8*a* and 8*b* are radiated in directions which are defined by the values $\theta$ and $\psi$ in expression (1). As the value $\psi$ decreases, the direction of reflection approaches the direction of advancement of the plane wave 5.

The plane wave 5 incident on the structure 10 is scattered as diffracted waves by the edge *7d*. As the edge *7d* is irregularly polygonally-shaped having sides each longer than the radiated wavelength, the diffracted waves due to the edge *7d* are scattered over a wide range. Thus, as the directions of advancement of the reflected waves approaches the direction of advancement of the plane wave and the diffracted waves are scattered over a wide range, the radiation levels of the scattered waves in the region where the value H is large are reduced.

Figure 6:
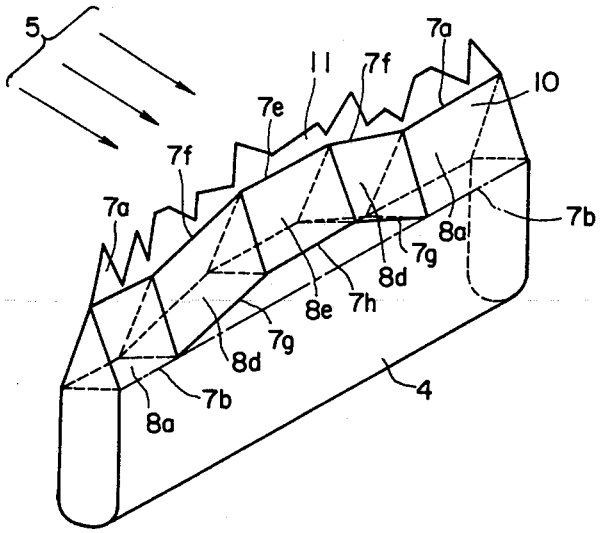

Another embodiment of the invention is shown in FIG. 6. In this embodiment, the surface of a supporting strut 4, on which a triangular strut 10 is mounted, is made up of a plurality of planes which are perpendicular to a plane which includes both the longitudinal direction of the supporting strut 4 and the direction of advancement of a plane wave 5.

With this arrangement, the directions and phases of waves reflected by surfaces 8*a*, 8*d* and 8*e* are different, and the directions and phase of diffracted waves due to edges *7a*, *7b*, *7e*, *7f*, *7g* and *7h* is also made different. Therefore, the radiation levels of the scattered waves are reduced.

Figure 20A:
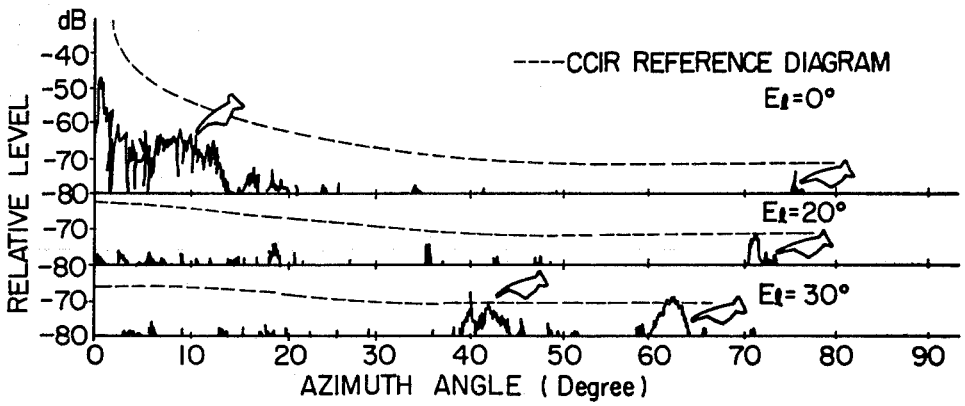
FIG. 20A is an explanatory diagram showing wide angle radiation characteristics of the conventional antenna.
Figure 20B:
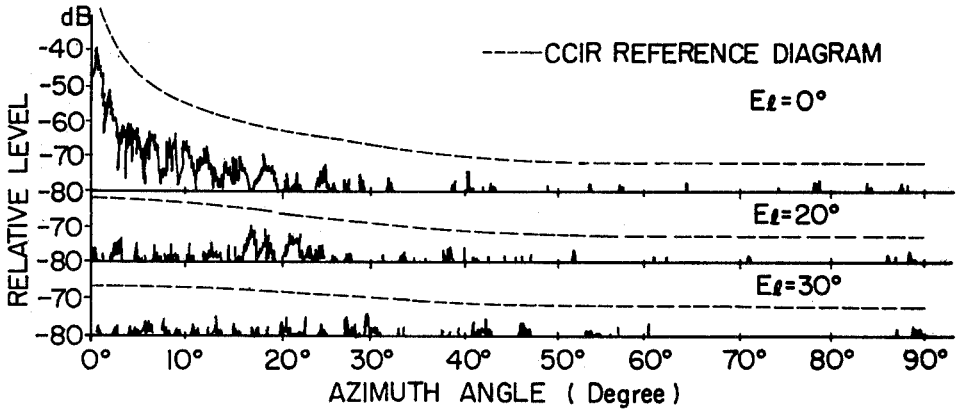
FIG. 20B is also an explanatory diagram showing wide angle radiation characteristics of the antenna using a supporting strut having a structure shown in FIG. 6.

FIGS. 20A and 20B are explanatory diagrams showing wide angle radiation characteristics of the antenna using a conventional supporting strut and the present antenna using a supporting strut having a structure shown in FIG. 6 for the purpose of comparison, where $E_l$ designates an elevation angle. As is clear from FIGS. 20A and 20B, according to the invention, the radiation levels of the scattered waves due to the supporting strut are effectively decreased.

Figure 7:
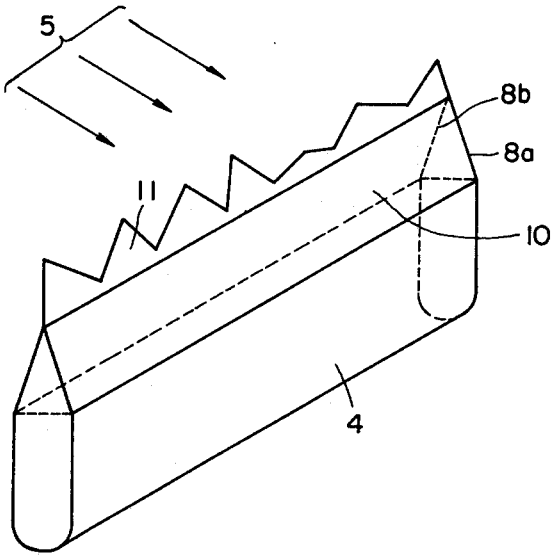

A third embodiment of the invention is shown in FIG. 7. In this embodiment, the structure 11 includes a plurality of polygonal members the sides of which are different in length and which are arranged irregularly to form a polygonal line. In this case also, the radiation levels of the scattered waves are reduced. In this embodiment, each of the polygonal members is triangular. However, the same effect can be obtained by employing rectangular members as the polygonal members or by employing rectangular members and triangular members in combination. Furthermore, the same effect can be obtained by rounding off some or all of the corners of the polygonal members.

As is apparent from the above description, according to the invention, the radiation levels of the scattered waves due to the supporting strut are decreased. Accordingly, an antenna having excellent wide-angle radiation characteristics is provided.

Figure 8:
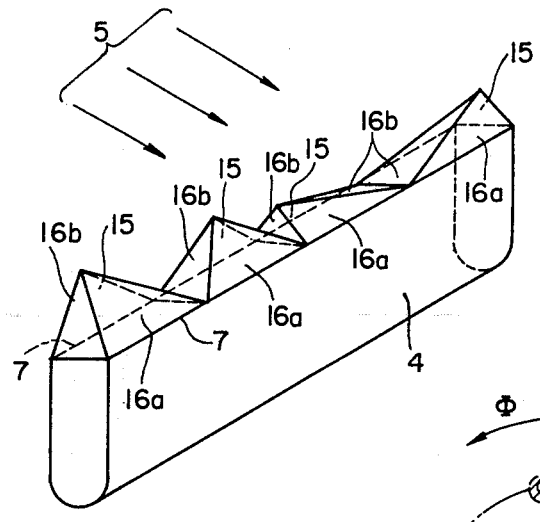

FIG. 8 shows another embodiment of the invention. In FIG. 5, reference numeral 4 designates a supporting strut, 5 a radiated plane wave, 7 edges along which quadrangular prisms are connected to the supporting strut 4, and 15 the quadrangular prisms. Two sides of the bottom of each quadrangular prism 15 which extend in the longitudinal direction of the supporting strut have a length and height equal to or larger than the radiated wavelength while the width of the remaining two sides of the bottom is equal to the width of the supporting strut. A plurality of plural types or shapes or quadrangular prisms, which are different in the length or height of the sides extending in the longitudinal direction of the supporting strut, are irregularly arranged on a surface, on the main reflector side, of the supporting strut in the case of a Cassegrain antenna, and on a surface, on the reflecting mirror side, of the supporting strut in the case of a parabolic antenna.

With this arrangement, waves scattered due to the quadrangular prisms 15 can be represented by the superposition of reflected waves from the surfaces 16*a* and 16*b* forming the quadrangular prisms 15, waves diffracted due to the connecting lines or edges of the surfaces 16*a* and 16*b*, and waves diffracted due to the connecting lines or the edges 7 of the quadrangular prisms 15 and the supporting strut 4. Among these waves, the waves reflected due to the surfaces 16*a* including an edge 7 are radiated in a direction which is defined by an angle $\theta$ formed between the direction of advancement of the plane wave 5 and the edge 7 and by half the angle formed between confronting surfaces 16*b*. The angle $\theta$ of the plural quadrangular prisms are equal to one another but the value of $\psi$ is different. Therefore, the waves reflected due to the surfaces 16*a* are scattered along the generating line of a circular cone which has the supporting strut as its central axis and a half vertical angle $\theta$. The waves reflected due to the other two surfaces 16*b* forming each quadrangular prism 15 are scattered along the H-axis with $\Phi=0$ where the value of $\psi$ is 90 degrees. As the plural quadrangular prisms have different angles between the surface 16*b* and the Z-axis, the waves reflected due to the surfaces 16*b* are scattered along the H-axis. The waves diffracted due to the edge are scattered in the form of a circular cone which is defined by a half vertical angle $\theta$ with the supporting strut as its central axis. The waves diffracted due to the other edges are scattered over a wide range as the angles formed between the edges and the Z-axis are different from one another. Since these quadrangular prisms are irregularly arranged, no grating lobe is produced.

Figure 9:
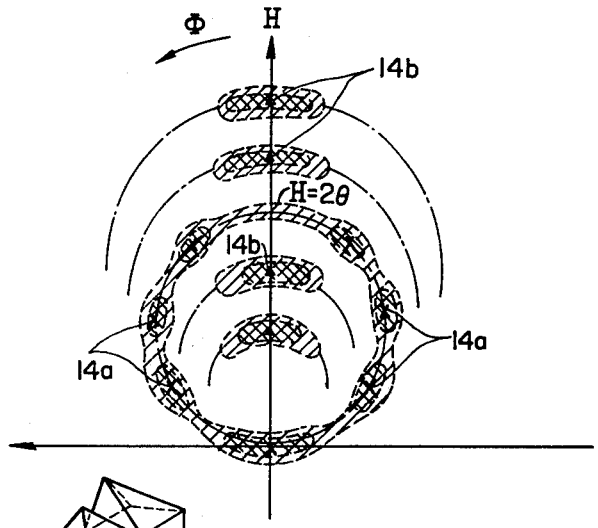
FIG. 9 is a diagram illustrating a radiation pattern of an antenna utilizing the supporting strut structure shown in FIG. 8.

The radiation pattern of the scattered waves due to the plural quadrangular prisms is as shown in FIG. 9. In FIG. 9, reflection points 14*a* indicate the directions of the reflected waves due to the surfaces 16*a*, and reflection points 14*b* indicates the directions of the reflected waves due to the surfaces 16*b*. As is apparent from the above description, as a plane wave incident on the supporting strut is scattered over a wide range, the field intensity levels of the scattered waves is reduced.

Figure 10:
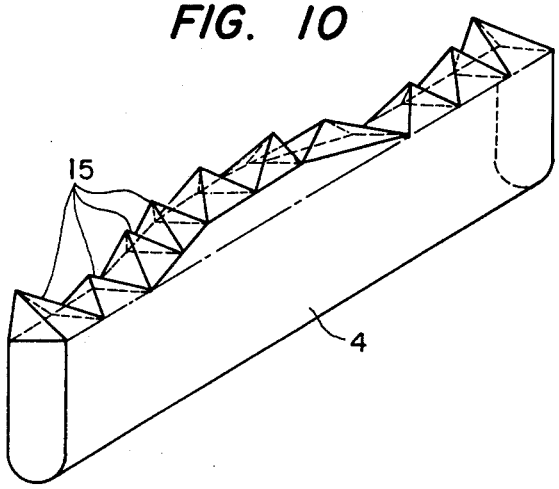

FIG. 10 shows yet another embodiment of the invention. In this embodiment, the above-described quadrangular prisms are mounted on a surface of a supporting strut which includes a plurality of surfaces which are perpendicular to a plane which includes both the direction of advancement of transmitted waves and the longitudinal direction of the supporting strut. In this arrangement, waves reflected due to the surfaces of the quadrangular prisms and waves diffracted due to the edges are scattered in a wider range, and the phases of the waves reflected due to the surfaces of the quadrangular prisms and of the waves diffracted due to the edges can be changed. Thus, in this case, the radiation level of the scattered waves is more effectively reduced.

Reference have been made to the case where the length of two sides of the bottom of each quadrangular prism which are perpendicular to the longitudinal direction of the supporting strut is equal to the width of the supporting strut. However, the same effect can be obtained even if the length of the two sides is made smaller than the width of the supporting strut.

As was described above, the scattered waves due to the supporting strut for the primary radiator or the subreflector obstructing the passage of the transmitted waves in the antenna of the invention are scattered over a wide range by irregularly arranging on a part or the whole of a surface of the supporting strut a plurality of plural types or shapes of quadrangular prisms with the length and height of two sides of the bottom of each quadrangular prism which extend in the longitudinal direction of the supporting strut being equal to or larger than the wavelength, the length of the remaining two sides being equal to or smaller than the width of the supporting strut, and the lengths or heights of the sides of the bottoms of the quadrangular prisms which extend in the longitudinal direction of the supporting strut being different from one another. Therefore, the radiation level of the scattered waves is reduced.

Figure 11A:
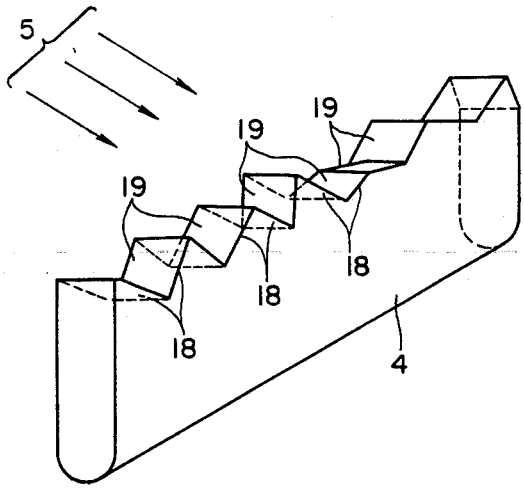
Figure 11B:
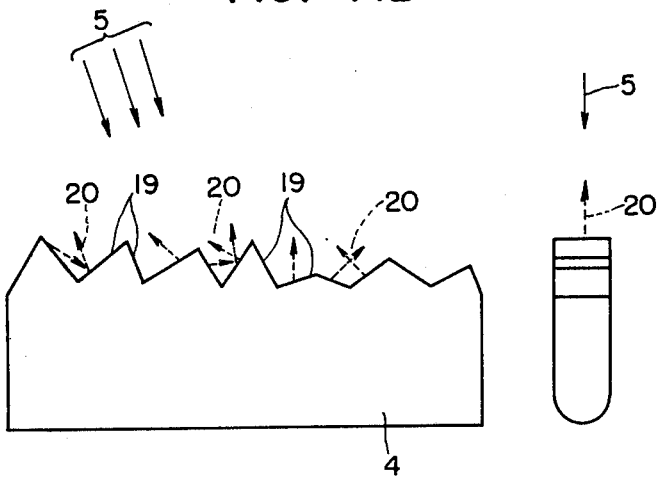

FIG. 11A shows another preferred embodiment of the invention. In FIG. 11A, reference numeral 4 designates the supporting strut, 5 is a radiated plane wave, and 19 surfaces of the supporting strut. A part or the whole of a surface, on the main reflector side, of the supporting strut is made up of a plurality of surfaces 19 perpendicular to a plane which includes both the longitudinal direction of the supporting strut 4 and the direction of advancement of the plane wave 5 in the case of a Cassegrain antenna. In the case of a parabolic antenna, a part or the whole of a surface, on the reflector side, of the supporting strut is made up of a plurality of surfaces 19 similar to those described above. Sections of the supporting strut in planes including the aforementioned two directions have the same configuration, and each section has an edge in the form of a plygonal line with sides each longer than the radiated wavelength.

Figure 3A:
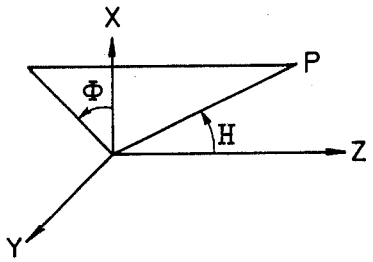
Figure 3B:
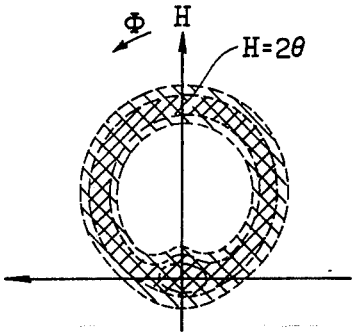
Figure 3C:
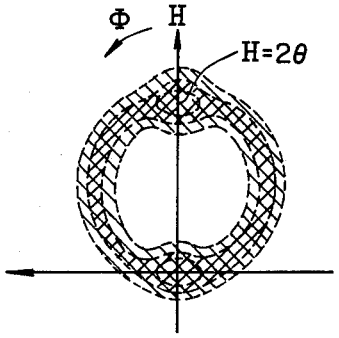

With this arrangement, waves scattered due to the supporting strut 4 can be represented by the superposition of waves reflected 10 due to the surfaces 19 and waves diffracted due to the polygonal edge 7. The surfaces 19 are perpendicular to the plane including both the direction of advancement of the plane wave 5 and the longitudinal direction of the supporting strut 4 and facing irregular directions. Therefore, the reflected waves 20 are scattered on the H-axis with $\Phi=0$ in FIG. 3. The diffracted waves are scattered over a wide range as the edge 18 is in the form of an irregular polygonal line.

Thus, plane waves incident on the supporting strut are scattered in one particular region, and accordingly the field strength of the scattered waves in the other regions is reduced. In the case of the above-described supporting strut, the configurations of the sections in given planes perpendicular to the "shadow" of the supporting strut projected onto the effective area of the surface on the reflector side are the same and are linear.

Figure 12A:
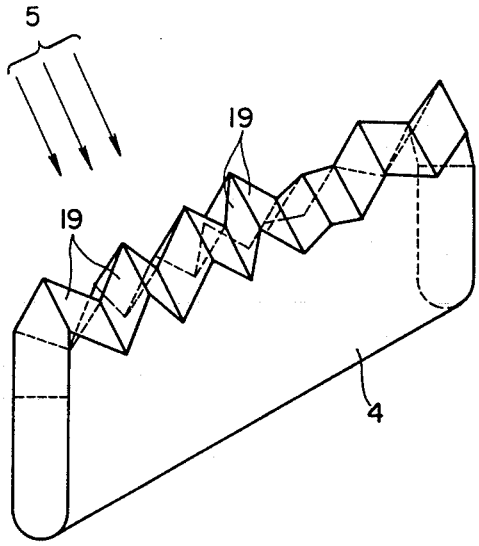

Yet another embodiment of the invention is shown in FIG. 12A. In this embodiment, the configurations of sections in given planes including both the longitudinal direction of the supporting strut and the direction of advancement of a plane wave 5 are the same, and each of the sections is in the form of an irregular polygonal line having segments each longer than the radiated wavelength. The configuration, on the reflector side, of a section in a plane perpendicular to the "shadow" of the supporting strut projected onto the effective area is formed by two sides which form an angle $\psi$ with the direction of advancement of the plane waves 5. Therefore, by decreasing the angle $\psi$, it is possible to make the directions of the reflected waves 10 approach the direction of advancement of the plane waves 5. Furthermore, since the surface 19 of the supporting strut is irregular, the phases of the reflected waves are made different, and accordingly the field strengths of the scattered waves is reduced.

Figure 12B:
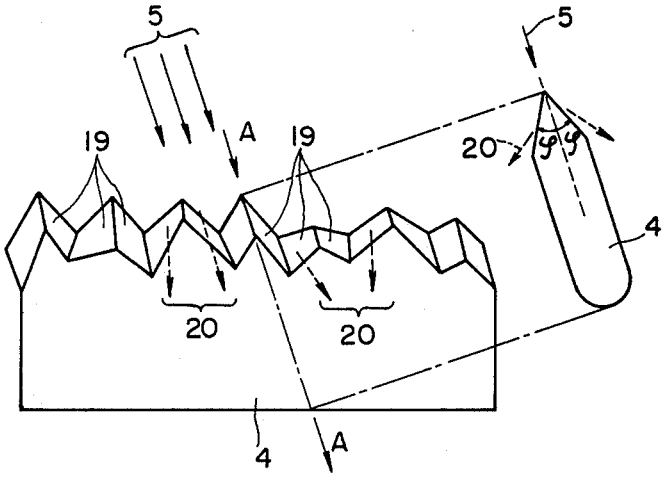

In still another embodiment of the invention, as shown in FIG. 12B, a plurality of surfaces are formed which are symmetrical with a plane which includes both the longitudinal direction of the supporting strut 4 and the direction of advancement of the plane waves 5 facing in various directions. The configuration of a section in the plane of symmetry is in the form of an irregular polygonal line composed of segments each being longer than the radiated wavelength. With the supporting strut thus constructed, waves reflected by the surfaces 8 are directed in various directions, and therefore the field strength of the scattered waves is decreased.

Figure 13A:
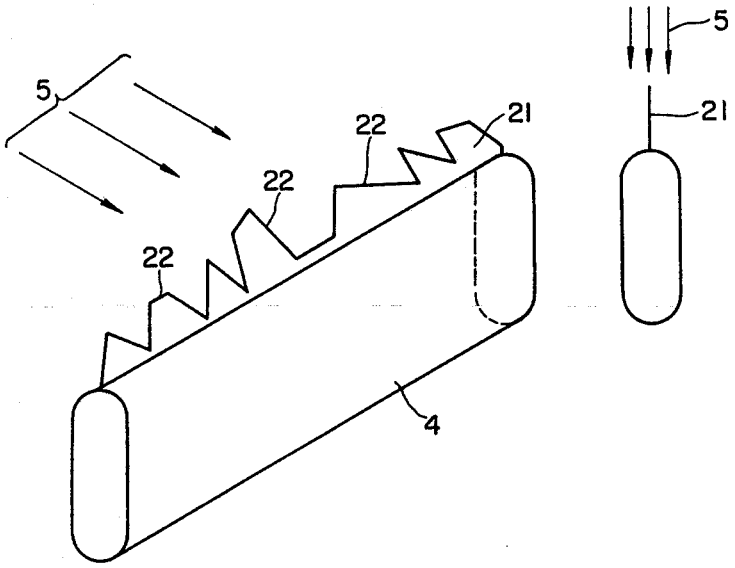

FIG. 13A shows an embodiment of the present invention in which 4 is the support pole structure, 5 is an incident plane wave and 21 is a planar member. The planar member 21 is a plate having a thickness smaller than the radiated wavelength. One end of the planar member 21 is connected to the supporting strut 4 along the length thereof while the other end is irregularly zigzag shaped and has a length greater than the radiated wavelength. The planar member 21 is connected to a main reflector side surface of the supporting strut 4 if the antenna is of Cassegrain type or to a reflector side surface of the supporting strut 4 if the antenna is a parabolic type, wherein the member lies in a plane parallel to a plane containing the lengthwise direction of the supporting strut 4 and the propagating direction of the plane waves 5.

With this arrangement, a plane wave 5 incident on the planar member 21 becomes a diffraction wave due to the edge 7 and is scattered. Since the length of the edge 7 is greater than the radiated wavelength and the shape thereof is an irregularly zigzag, waves diffracted by the edge 7 are widely scattered thereby reducing the field strength of the diffracted waves.

Figure 13B:
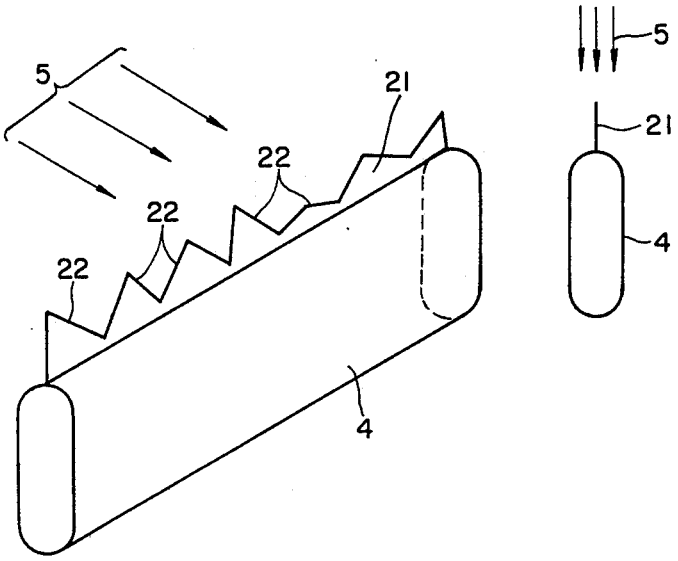

The same effect may be obtained by irregularly arranging a plurality of protrusions each having different length or size instead of the planar member having the zigzag shape, as shown in FIG. 13B. Therefore, since a portion of the incident plane waves 5 are widely scattered, the field strength of the waves scattered by the support pole structure is reduced.

In FIG. 13B, the protrusions are shown as being triangular in shape. However, the same effect can be obtained by providing protrusions having rectangular shapes or combination of rectangular shapes and triangle shapes. The same effect is also obtainable by rounding corners of a portion or the whole of the irregular zigzag shapes.

Figure 14A:
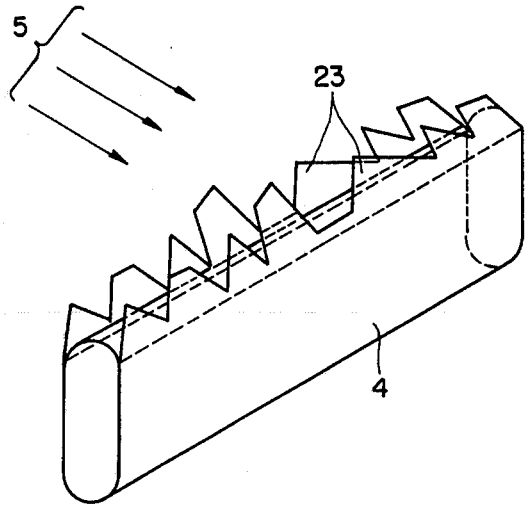

FIG. 14A shows an embodiment of the present invention in which 4 is the supporting strut, 5 is the incident plane wave and 23 indicates two planar members. Each planar member 23 is a plate having a thickness less than the radiated wavelength. One end of the planar member 23 is connected to the supporting strut 4 along the length thereof while the other end is irregularly zigzag shaped having segments with a length greater than the radiated wavelength. The planar members 23 are attached on either side of a main reflector side surface of the supporting strut 4 if the antenna is of Cassegrain type or to both sides of a reflector side surface of the supporting strut 4 if the antenna is a parabolic type, such that the planar members lie in planes parallel to a plane containing the lengthwise direction of the supporting strut 4 and the propagating direction of the plane waves 5.

Figure 14B:
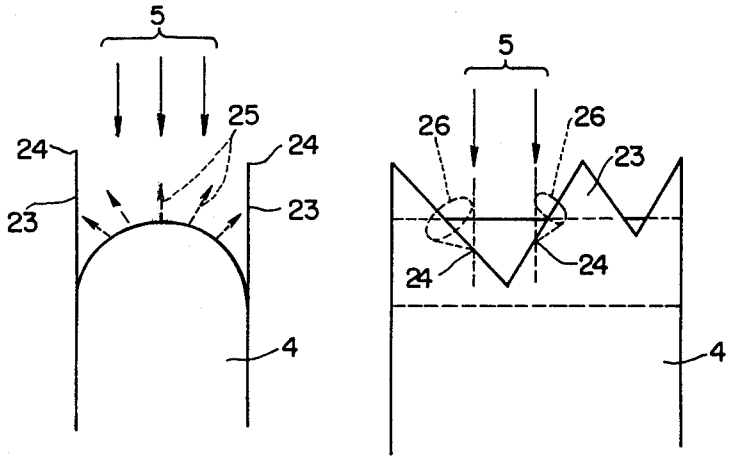

With this arrangement, a plane wave 5 incident on the plane member 23 reflected by the supporting strut 4 becomes a diffracted wave due to an edge 7 of the planar members. The diffracted waves are scattered as shown in FIG. 14B. A portion of a reflected wave 25 which propagates toward the planar members 23 is scattered again by the edges 7. Since the length of each edge 7 is greater than the radiated wavelength and the shape thereof is an irregularly zigzag, waves diffracted due to the edges 7 are widely scattered. Since the phases thereof are different, the field strength of the scattered waves, which are a combination of the waves reflected and the diffracted waves, is reduced.

Figure 15:
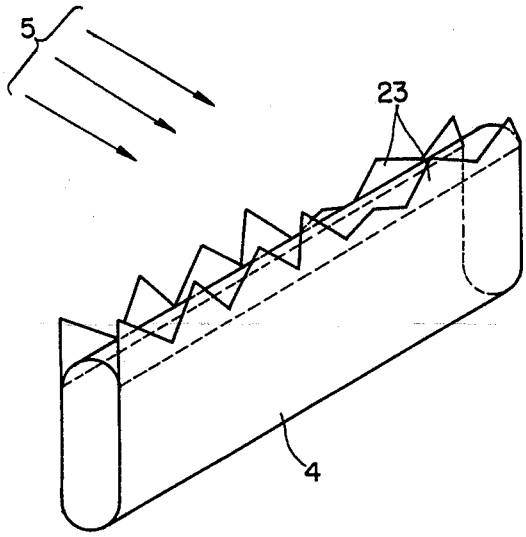

The same effect may be obtained by irregularly arranging a plurality of protrusions each having different length or size instead of the planar members having the zigzag shape as shown in FIG. 15.

In FIG. 15, the protrusions are triangular in shape. However, the same effect can be obtained by providing protrusions having a rectangular shape or combinations of rectangular and triangle shapes. Further in FIGS. 14A, 14B and 15 although a case where the plate members 23 have the same configuration are attached to the both sides of the supporting strut 4 has been described, the same effect may be obtained by making the shapes of the plate member 23 different or by rounding corners of a portion or the whole of the irregular zigzag shapes.

Figure 1:
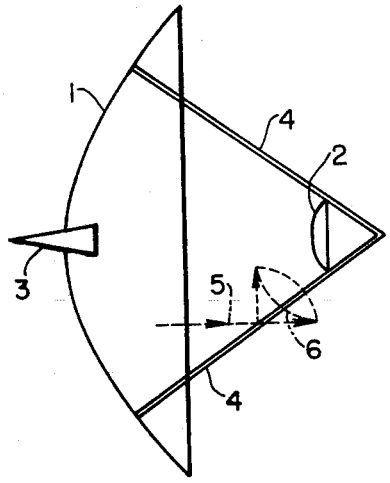
FIGS. 1 and 4 are cross-sectional views of prior art antennas used in the microwave or millimeter waveband.
Figure 2A:
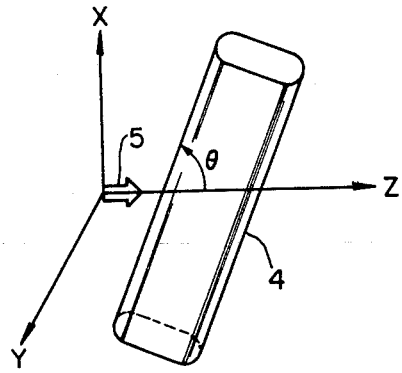
FIGS. 2A–2C and 3A–3C are diagrams used for illustrating radiation patterns from the antennas of FIGS. 1 and 4.
Figure 2B:
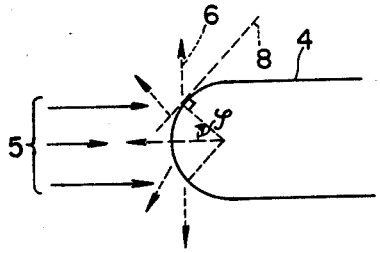
Figure 2C:
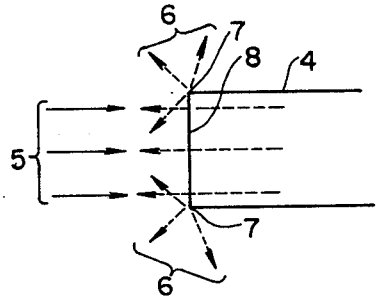
Figure 4:
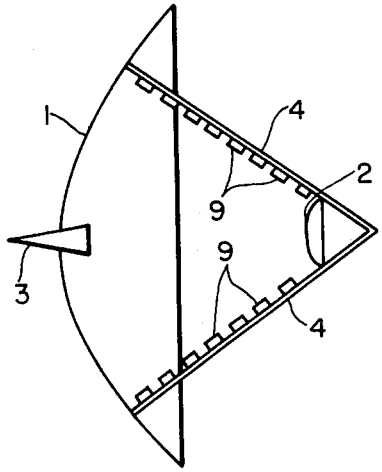
Figure 16A:
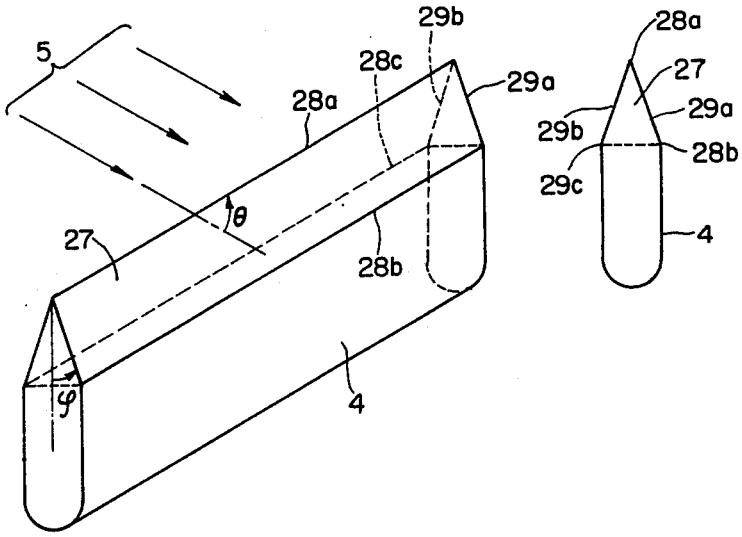

In the embodiment shown in FIG. 16A, 4 is the supporting strut, 5 is an incident plane wave and 27 is a triangular strut. In this case, the cross-sectional shape of the strut 27 taken alone a plane orthogonal to the lengthwise direction of the supporting strut 4 is triangular with the length of the base of the triangle, with which the triangular strut is connected to the supporting strut, being equal to the width of the supporting strut 4. The lengths of the remaining two sides of the triangle are longer than the radiated wavelength, and the length of the triangular strut 27 along the supporting strut is longer than the radiated wavelength. The triangular strut 27 is formed on the supporting strut on the side of a surface of a main reflector if the antenna is of the Cassegrain type or formed on the supporting strut on the side of the reflector supported thereby if the antenna is of a parabolic type. An edge **28*a* is formed by connecting apexes of cross-sectional triangles of the triangular strut 27 and edges 28*b* and 28*c* form connecting portions to the supporting strut 4**.

Figure 16B:
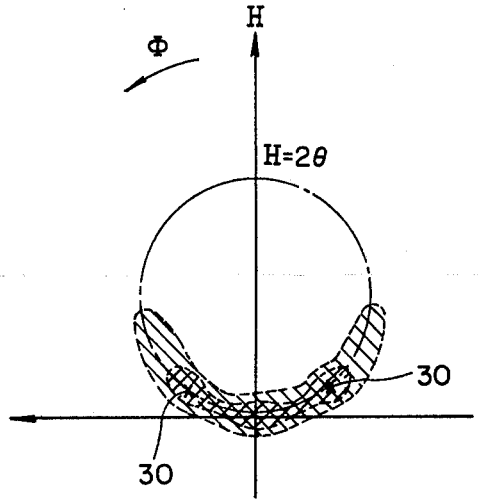
FIG. 16B is a diagram illustrating a radiation pattern of an antenna employing the supporting strut structure of the embodiment shown in FIG. 16A.

With this arrangement, a portion of incident plane waves 5 scattered by the supporting strut 4 is represented by a combination of waves diffraction due to the edges **28*a*, 28*b* and 28*c* and waves reflected due to planes 29*a* and 29*b*. The direction of the waves reflected due to the planes 29*a* and 29*b* are determined by $\theta$ and $\psi$ according to equation 1. Therefore, by making the value of $\psi$ small, the reflected direction 30 is made closer to the propagating direction of the plane waves 5. Therefore, the radiation pattern of the scattered waves is as shown in FIG. 16B. Although there may be left some diffraction waves due to the edge 28*a***, it is possible to reduce the field strength of the scattered waves in the area where H is large.

Figure 17:
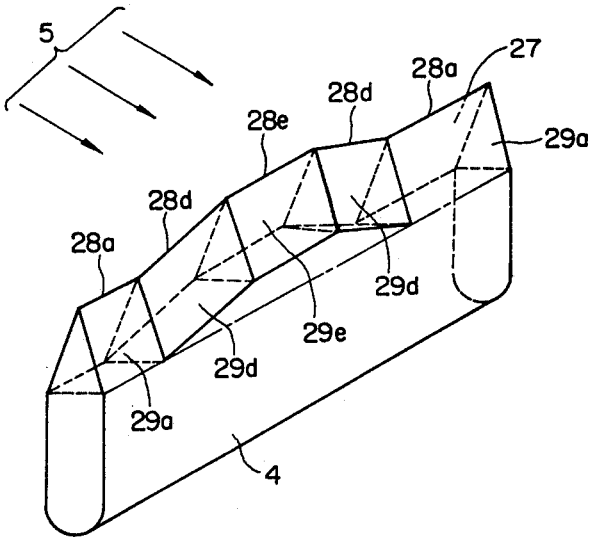

FIG. 17 shows another embodiment in which the surface configuration of the supporting strut 4 to be mounted on the triangular strut structure 27 is composed of a plurality of planes orthogonal to the plane containing the lengthwise direction of the supporting strut 4 and the propagating direction of the plane waves 5.

With this arrangement, the direction and the phases of the reflected wave are changed from the planes 29*a*, and 29*d* and 29*e*, respectively, as well as changing the direction and phases of the waves diffracted due to the edges 28*a*, 28*d* and 28*e*. Therefore, it is possible to further reduce the field strengths of the waves scattered due to the supporting strut structure.

Figure 18A:
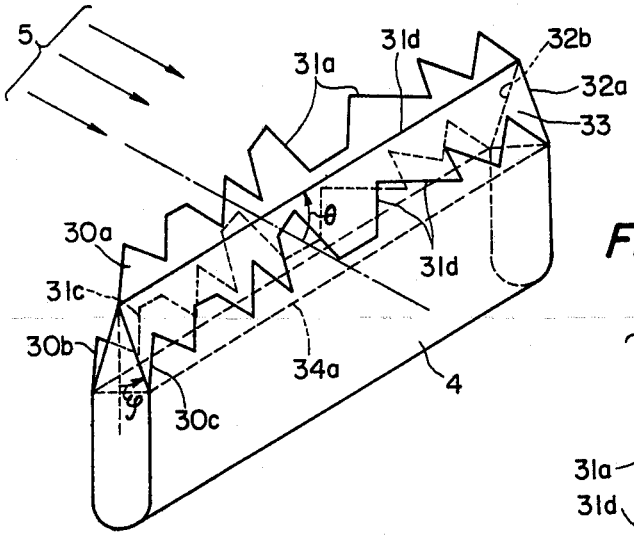
Figure 18B:
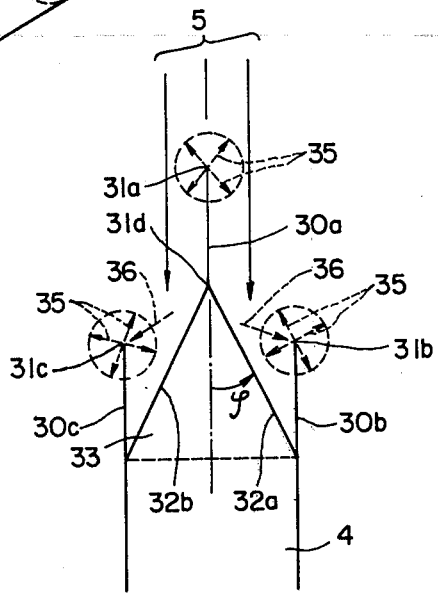

In the embodiment of FIG. 18A, reference numeral 4 designates the supporting strut, 5 the incident plane wave, 33 a triangular prism, and 30*a*–30*c* planar members. The configuration of a section of the strut 33 perpendicular to the longitudinal axis of the supporting strut 4 is such that the length of two sides of the bottom of the triangular strut, which is mounted to the supporting strut 4, is equal to the width of the supporting strut 4, the remaining two sides are longer than the radiated wavelength, and the length of the triangular strut 33 along the longitudinal axis of the supporting strut 1 is longer than the radiated wavelength. Each planar member 30*a*–30*c* is in the form of a flat plate having one edge connected to a longitudinal edge of the triangular strut 33 and another edge which is in the form of a polygonal line composed of segments each longer than the radiated wavelength. The triangular strut is mounted on a surface, on the main reflector mirror side, of the supporting strut in the case of a Cassegrain antenna, and on a surface on the reflector side of the supporting strut in the case of a parabolic antenna. The planar members 30*a*–30*b* are connected to respective three longitudinal edges of the triangular strut 33 in such a manner that they are in parallel with a plane which includes both the longitudinal direction of the supporting strut and the direction of advancement of the plane waves 5. The planar members 30*a*, 30*b* and 30*c* have edges 31*a*, 31*b* and 31*c*, respectively. An edge 31*d* is the connecting line of the member 30*a* and the triangular strut 33. The triangular strut 33 has side surfaces 32*a* and 32*b* extending longitudinally.

With this arrangement, the scattered waves can be represented by the superposition of waves diffracted due to the edges 31*a*, 31*b*, 31*c* and 31*d* and waves reflected due to the surfaces 32*a* and 32*b*. If the half vertical angle $\psi$ of the triangular section of the triangular strut 33 is decreased, then the field strength of the waves diffracted due to the edge 31*d* are reduced. Also, the directions of advancement of the waves reflected due to the edge 31*d* then approaches the planar members 30*b* and 30*c*. As the edges 31*a*, 31*b* and 31*c* of the planar members 30*a*, 30*b* and 30*c* are each in the form of an irregular polygonal line composed of segments longer than the radiated wavelength, the plane waves 5 incident on these edges and the resulting scattered waves are scattered as diffracted waves with different phases over a wide range. Therefore, the scattered waves are reduced in field strength.

Figure 19:
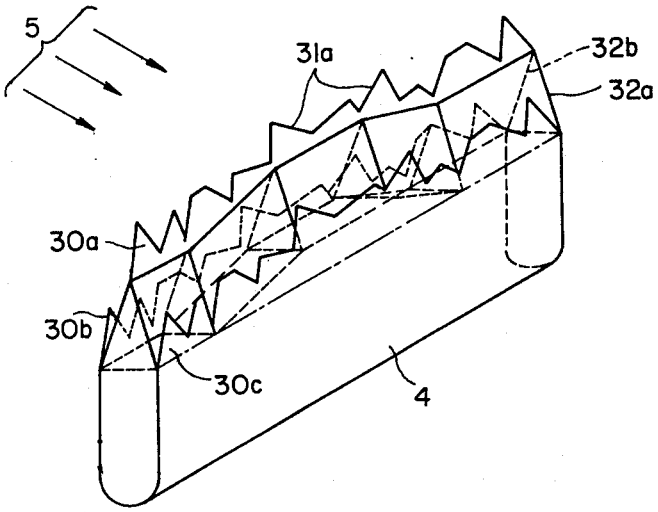

FIG. 19 shows another embodiment of the invention in which a surface of the supporting strut 4 on which a triangular strut 33 and planar members 30*a*, 30*b* and 30*c* are mounted is made up of a plurality of surfaces which are perpendicular to a plane which includes both the longitudinal direction of the supporting strut and the direction of advancement of plane waves 5. With this arrangement, the reflected waves and the diffracted waves are made different in direction and in phase. Therefore, the scattered waves are reduced in radiation level.

The planar members used in the embodiments of FIGS. 18A and 19 are formed with a plurality of triangular or rectangular members. The same effect can be obtained by employing planar members which include a plurality of triangular or rectangular members which have different side lengths or sizes and are arranged irregularly. Furthermore, the same effect can be obtained by rounding off the protruding corners of some or all of the triangular or rectangular members.

Although the foregoing explanation relates to the electromagnetic waves being plane waves, the present invention is also applicable to spherical electromagnetic waves with a similar effect. In such a case, the shape of each through-hole should be conical.

What is claimed is:

1. An antenna for the microwave or millimeter waveband comprising: at least one supporting strut extending into an aperture of said antenna; at least one triangular strut provided on at least a part of said supporting strut, a section of said triangular strut perpendicular to a longitudinal axis of said supporting strut being in a form of a triangle having one side which is connected to said supporting strut, said one side being equal in length to a width of said strut, and remaining two sides of which are longer than the wavelength of waves radiated by said antenna device, and the length of said triangular strut in said longitudinal direction of said supporting strut being longer than said wavelength; and a planar member having a thickness less than said wavelength, said planar member having one edge connected to an outer edge of said triangular strut away from said supporting strut and an opposite edge cut in the form of a polygonal having a plurality of segments each of which is longer than said wavelength, a plane of said planar member being parallel to a plane including said longitudinal direction of said supporting strut and a direction of propagation of said waves.

2. The antenna as claimed in claim 1 wherein said surface of said supporting strut upon which said triangular strut is provided includes at least one surface which is perpendicular to a plane including both said longitudinal direction of said supporting strut and the direction of propagation of said waves.

3. The antenna as claimed in claim 1 or 2 wherein at least some of said segments are of different lengths.

4. The antenna as claimed in claim 1 or 2 wherein at least some of said segments are of different lengths, and wherein at least some corners of said segments are rounded.

5. An antennar for the microwave or millimeter waveband comprising: at least one supporting strut extending into an aperture of said antenna; and a plurality of quadrangular prisms arranged irregularly on at least a part of a surface of said supporting strut, a length and height of two sides of a bottom of each said quadrangular prism extending in a longitudinal direction of said supporting strut being equal to or greater than the wavelength of waves radiated by said antenna, a length of two remaining sides of each said quadrangular prism being equal to or less than a width of said supporting strut, and at least some lengths of said sides of said bottoms of said quadrangular prisms being different from one another.

6. The antenna as claimed in claim 5 wherein said supporting strut has a surface upon which said quadrangular prisms are mounted including a plurality of surfaces perpendicular to a plane including both said longitudinal direction of said supporting strut and a direction of propagation of waves radiated by said antenna.

7. In a Cassegrain antenna for the microwave or millimeter waveband having at least one supporting strut extending into an aperture of said antenna, the improvement comprising said supporting strut having a surface on a main reflector side composed of a plurality of surfaces which are symmetrical with a plane including both a longitudinal direction of said supporting strut and a direction of propagation of waves radiated by said antenna, the configuration of a section of said supporting strut in said plane being in the form of an irregular polygonal line having a plurality of segments each of which is longer than said wavelengths of said radiated waves.

8. In a parabolic antenna for the microwave or millimeter waveband having at least one supporting strut extending into an aperture of said antenna, the improvement comprising said supporting strut having a surface on a reflector side composed of a plurality of surfaces which are symmetrical with a plane including both a longitudinal direction of said supporting strut and a direction of propagation of waves radiated by said antenna, the configuration of a section of said supporting strut in said plane being in the form of an irregular polygonal line having a plurality of segments each of which is longer than said wavelengths of said radiated waves.

9. An antenna for the microwave or millimeter waveband comprising: at least one supporting strut extending into an aperture of said antenna, and at least one planar member having one edge connected to said supporting strut and the opposite edge thereto having an irregular zigzag shape, said planar member extending along at least a portion of the length of said supporting strut and being in a plane parallel to a plane containing the lengthwise direction of said supporting post and a direction of propagation of waves radiated from said antenna, a thickness of said planar member being less than said wavelength of said radiated waves, and the length of segments of said end having said irregular zigzag shape being longer than said wavelength of said radiated waves.

10. The antenna as claimed in claim 9 wherein at least a portion of corners of said irregular zigzag shaped edge are rounded.

11. The antenna as claimed in claim 9 wherein one of said planar members is provided along a center line of said supporting strut.

12. The antenna as claimed in claim 9 wherein first and second ones of said planar members are provided disposed on opposite side surfaces of siad supporting post.

13. The antenna as claimed in claim 12 wherein the shapes of said irregular zigzag edges are similar to one another between said first and second planar members.

14. The antenna as claimed in claim 12 wherein the shapes of said irregular zigzag edges are different from one another.

15. An antenna for the microwave or millimeter waveband comprising: at least one supporting strut extending into an aperture of said antenna; and a triangular strut formed on at least a portion of a surface of said supporting strut, the shape of said triangular strut in a plane orthogonal to a longitudinal direction of said supporting strut being triangular, a length of a side of said triangular strut where said triangular strut is connected to said supporting strut being equal to the width of said supporting strut, lengths of remaining two sides of said triangular strut being longer than a wavelength of waves radiated from said antenna, and a length of said triangular strut along said supporting strut being longer than said wavelength of said radiated waves.

16. The antenna as claimed in claim 15 wherein said supporting strut has surfaces on which said triangular strut is positioned having at least one plane orthogonal to a plane including said longitudinal direction of said supporting strut and a direction of propagation of said radiated waves.

17. An antenna for the microwave or millimeter waveband comprising: at least one supporting strut extending into an aperture of said antenna; a triangular strut provided on at least a part of a surface of said supporting strut, a section of said triangular strut perpendicular to a longitudinal axis of said supporting strut being in the form of a triangle having one side which is connected to said supporting strut, said side connected to said supporting strut being equal in length to a width of said supporting strut, and remaining two sides of said section being longer than a wavelength of waves radiated by said antenna, a length of said triangular strut in said longitudinal direction of said supporting strut being longer than said radiated wavelength; and first through third planar members each having a thickness less than said wavelength of said radiated waves, each of said planar members having a first edge which is connected to a corresponding longitudinal edge of said triangular strut and a second edge formed in the shape of an irregular polygonal line having segments each of which is longer than said wave length of said radiated waves, said planar members each being parallel to a plane including both said longitudinal direction of said supporting strut and a direction of propagation of said radiated waves.

* * * * *